United States Patent [19]

Goffe

[11] 3,976,483

[45] Aug. 24, 1976

[54] ERASING PROCESS

[75] Inventor: William L. Goffe, Webster, N.Y.

[73] Assignee: Xerox Corporation, Stamford, Conn.

[22] Filed: Jan. 2, 1970

[21] Appl. No.: 184

[52] U.S. Cl. ..... 96/1 PS

[51] Int. Cl.[2] ..... G03G 13/00

[58] Field of Search ..... 96/1, 1.5, 1 R, 1.3, 96/1.8, 1 PS

[56] References Cited

UNITED STATES PATENTS

| | | | |
|---|---|---|---|
| 2,919,119 | 12/1959 | Vyverberg et al. | 96/1 R |
| 3,041,167 | 6/1962 | Blakney et al. | 96/1.4 |
| 3,199,086 | 8/1965 | Kallmann et al. | 96/1.5 X |
| 3,288,624 | 11/1966 | Clark | 96/1 SD |
| 3,355,289 | 11/1967 | Hall et al. | 96/1.4 |
| 3,438,706 | 4/1969 | Tanaka et al. | 96/1 UX |
| 3,457,070 | 7/1969 | Watanabe et al. | 96/1 X |
| 3,519,420 | 7/1970 | Goffe | 96/1 |
| 3,520,681 | 7/1970 | Goffe | 96/1 |
| 3,556,781 | 1/1971 | Levy et al. | 96/1 R |
| 3,656,990 | 4/1972 | Goffe | 96/1 R |

FOREIGN PATENTS OR APPLICATIONS

| | | | |
|---|---|---|---|
| 1,082,914 | 9/1967 | United Kingdom | 96/1 |

OTHER PUBLICATIONS

Cassiers, R. M. "Memory Effects in Electrophotography," The Journal of Photographic Science, vol. 10, (1962), pp. 57–64.

*Primary Examiner*—Douglas J. Drummond
*Assistant Examiner*—Basil J. Lewris
*Attorney, Agent, or Firm*—Gaetano D. Maccarone; Michael H. Shanahan; James J. Ralabate

[57] ABSTRACT

A migration imaging electrical latent image erasing process comprising providing an imaging member comprising fracturable migration material in a softenable layer; said member having a first electrical latent image of a first polarity, erasing said first electrical latent image by electrically charging said member with charge of a polarity opposite said first polarity to bring said member in imaging area portions to at least about zero potential, then forming a later electrical latent image, typically differing in composition from said first electrical latent image, which may be of either polarity, on said member. If said member is migration developed, migration material migrates at least in depth in said softenable layer in an image configuration corresponding to said later electrical latent image and not said first electrical latent image.

4 Claims, 7 Drawing Figures

INVENTOR.
WILLIAM L. GOFFE

BY David C. Petre

ATTORNEY

ERASING PROCESS

BACKGROUND OF THE INVENTION

This invention relates in general to imaging, and more specifically to migration imaging and a process for erasing electrical latent images from migration imaging members.

Recently, a migration imaging system capable of producing high quality images of high density, continuous tone, and high resolution has been developed. Such migration imaging systems are disclosed in copending applications Ser. No. 837,780 and Ser. No. 837,591, both filed June 30, 1969 which are hereby expressly incorporated herein by reference. In a typical embodiment of the new migration imaging system an imaging member comprising a substrate with a layer of softenable material and electrically photosensitive particles is imaged in the following manner: a latent image is formed on the member, for example, by electrically charging the member and exposing it to a pattern of activating electromagnetic radiation such as light. Where the photosensitive marking material is originally in the form of a migration layer spaced apart from the substrate, material from the migration layer migrates imagewise toward the substrate when the member is developed by softening the softenable layer.

One mode of development entails exposing the member to a solvent which dissolves only the softenable layer. The photosensitive marking material (typically particles) which have been exposed to radiation migrate through the softenable layer as it is softened and dissolved, leaving an image of migrated particles corresponding to the radiation pattern of an original on the substrate with the material of the softenable layer substantially completely washed away. The particle image may then be fixed to the substrate. For many preferred photosensitive particles, the image produced by the above process is a negative of a positive original, i.e., particles deposit in image configuration corresponding to the radiation exposed areas. However, positive to positive systems are also possible by varying imaging parameters. Those portions of the photosensitive material which do not migrate to the substrate are washed away by the solvent with the softenable layer. As disclosed therein, by other developing techniques, the softenable layer may at least partially remain behind on the supporting substrate with or without a relatively unmigrated pattern of marking material complementary to said migrated material.

In another imaging member embodiment migration material is dispersed throughout the softenable layer in a binder layer configuration.

"Softenable" as used herein is intended to mean any material which can be rendered more permeable to migration material migrating through its bulk. Conventionally, changing permeability is accomplished by dissolving, melting, and softening as by contact with heat, vapors, partial solvents and combinations thereof.

"Fracturable" layer or material as used herein, means any layer or material which is capable of breaking up during development, thereby permitting portions of said layer to migrate toward the substrate in image configuration. The fracturable layer may be particulate, semi-continuous, or continuous in various embodiments of the migration imaging members.

"Contiguous", for the purpose of this invention, is defined as in Webster's New Collegiate Dictionary, Second Edition, 1960: "In actual contact; touching; also, near, though not in contact; adjoining."

In certain methods of forming the latent image, nonphotosensitive or inert, fracturable layers and particulate material may be used to form images, for example, wherein an electrostatic latent image is formed by a wide variety of methods including charging in image configuration through the use of a mask or stencil; first forming such a charge pattern on a separate photoconductive insulating layer according to conventional xerographic reproduction techniques and then transferring this charge pattern to the imaging member by bringing the two layers into very close proximity and utilizing breakdown techniques as described, for example, in Carlson U.S. Pat. No. 2,982,647 and Walkup U.S. Pat. Nos. 2,825,814 and 2,937,943. In addition, charge patterns conforming to selected, shaped, electrodes or combinations of electrodes may be formed by the "TESI" discharge techniques as more fully described in Schwertz U.S. Pat. Nos. 3,023,731 and 2,919,967 or by techniques described in Walkup U.S. Pat. Nos. 3,001,848 and 3,001,849 as well as by electron beam recording techniques, for example, as described in Glenn U.S. Pat. No. 3,113,179.

The characteristics of the images produced are dependent on such process steps as charging, exposure and development, as well as the particular combination of process steps. High density, continuous tone and high resolution are some of the image characteristics possible. The image is generally characterized as a fixed or unfixed particulate image with or without a portion of the softenable layer and unmigrated portions of the layer left on the imaged member.

Within the framework of the discovery of this basic new migration imaging system, the present invention has been discovered which permits electrical latent image erasing, which includes the erasing of any prior history on said member, followed by the formation of a new electrical image on said member. This latent image erasure capability is much sought after when commercializing most any imaging system and especially a storage microimaging system which this migration imaging system lends itself so well to.

SUMMARY OF THE INVENTION

It is, therefore, an object of this invention to provide a migration imaging electrical latent image erasing process.

It is a further object of this invention to provide a migration imaging electrical latent image erasing process wherein a plurality of different electrical latent images may be erased from the same imaging surface of an imaging member before the final electrical latent image is formed and developed.

It is a further object of this invention to provide a migration image electrical latent image erasing process to erase, before electrically imaging said member, any prior history of charges and/or activating radiation that may have become associated, however inadvertently, with the member for example, during manufacture, shipping, storage, etc.

The foregoing objects and others are accomplished in accordance with this invention by providing a migration imaging electrical latent image erasing process comprising providing an imaging member comprising fracturable material in a softenable layer; said member having a first electrical latent image of a first polarity, erasing said first electrical latent image by electrically charging said member with charge of a polarity opposite said first polarity to bring said member in imaging area portions to at least about zero potential, then forming a later electrical latent image, typically differing in composition from said first electrical latent image, which may be either polarity, on said member. If said member is migration developed, migration material migrates at least in depth in said softenable layer in an image configuration corresponding to said later electrical latent image and not said first electrical latent image.

BRIEF DESCRIPTION OF THE DRAWINGS

For a better understanding of the invention as well as other objects and further features thereof, reference is made to the following detailed disclosure of this invention taken in conjunction with the accompanying partially schematic drawings wherein.

This optional uniform exposure step is also useful when electrically photosensitive migration material is used and the first electrical latent image to be erased is an electrostatic latent image, for example, formed by charging through a stencil, wherein the electrical latent image is perfected by a uniform blanket exposure, this exposure step decreasing the potential of the electrostatic latent image necessary for migration. As elaborated on hereinafter, two preferred modes of erasing such an image are (1) first charge the member to the same potential and the same polarity as the electrostatic latent image areas and to recharge the member to an opposite polarity to bring it to about zero potential and (2) to AC corona charge the member to about zero potential. In these preferred erasing techniques, the uniform exposure step of this invention illustrated in FIG. 4 may be used in (1) to advantage during or after the charging step which raises the member to the same potential as the electrostatic latent image and before the step where the member is charged to an opposite polarity to bring it to about a zero potential and in (2) where the uniform exposure occurs before or during or after AC corona charging.

Figure 5:
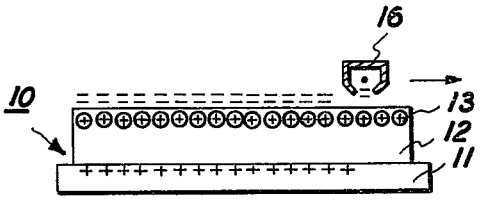

FIG. 5 is a representation of the step of electrically charging with a charge of a polarity opposite said first polarity to bring the member in imaging areas to at least about zero potential and preferably to a low potential of a polarity opposite said first polarity to erase the first electrical latent image. The preferred case of a low potential of an opposite polarity is illustrated.

To form a new, different and later electrical latent image in or on member 10, the steps shown in FIG. 2 and FIG. 3 may be repeated typically after the step illustrated in FIG. 5, with the image pattern of actinic radiation in FIG. 3 being the different, later imagewise pattern of actinic radiation. Also the later electrical latent image may be formed by a variety of non-exposure techniques such as charging through a stencil, which permits use of almost any material as the migration material so long as the material is fracturable and preferably forms small particles.

Figure 6:
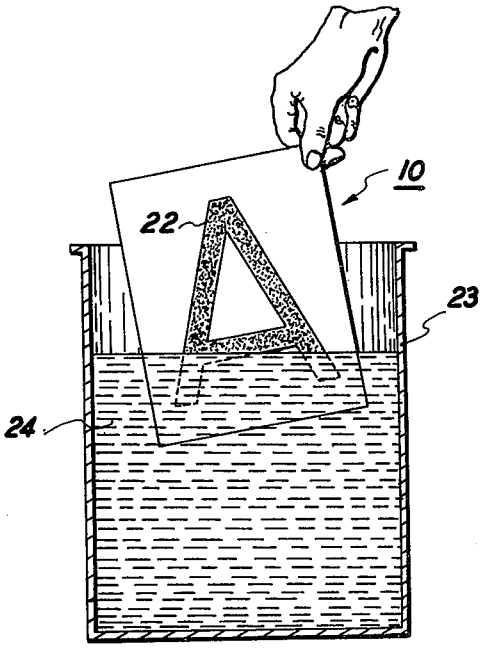

FIG. 6 is a perspective view of a mode of development of the later latent image produced according to this invention.

Figure 1:
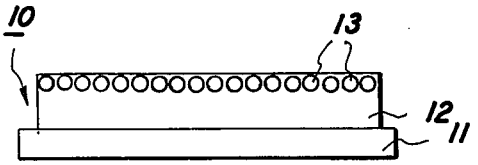
FIG. 1 is an illustration of an embodiment of an imaging member according to the invention.
Figure 7:
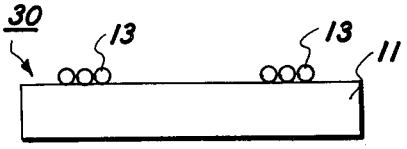

FIG. 7 is a cross section of the imaging member of FIG. 1 after processing according to a washaway development mode of the invention.

DESCRIPTION OF THE PREFERRED EMBODIMENTS

Referring now to FIG. 1, there is shown an example of one embodiment of an imaging member 10 according to this invention comprising substrate 11, electrically insulating softenable layer 12 which contains at its upper surface a fracturable layer of particulate material 13, the size of the member exaggerated for purposes of illustration.

Substrate 11 may be electrically conductive or insulating. Conductive substrates, especially when grounded, generally facilitate the charging or sensitization of the member according to the invention and typically may be of copper, brass, nickel, zinc, chromium, stainless steel, conductive plastics and rubbers, aluminum, steel, cadmium, silver and gold. The substrate may be in any suitable form such as a metallic strip, sheet, plate, coil, cylinder, drum, endless belt, moebius strip or the like. If desired, the conductive substrate may be coated on an insulator such as paper, glass or plastic. Examples of this type of substrate are a substantially transparent tin oxide coated glass available under the trademark NESA from the Pittsburgh Plate Glass Co.; aluminized polyester film, the polyester film available under the trademark Mylar from the E. I. DuPont de Nemours & Co.; or Mylar coated with copper iodide.

Electrically insulating substrates may also be used which opens up a wide variety of film formable materials such as plastics for use as substrate 11.

Alternatively, the softenable layer may be self-supporting and may be brought into contact with a suitable substrate during imaging, if desired.

Softenable layer 12 may be any suitable material which is soluble or softenable in a solvent liquid or vapor or heat or combinations thereof, and in addition, is substantially electrically insulating during the latent image forming and developing steps hereof. Typical materials include Staybelite Ester 10, a partially hydrogenated rosin ester, Foral Ester, a hydrogenated rosin triester, and Neolyne 23, an alkyd resin, all from Hercules Powder Co.; SR type silicone resins available from General Electric Corporation; Sucrose Benzoate, Eastman Chemical; Velsicol X-37, a polystyrene-olefin copolymer from Velsicol Chemical Corp.; Hydrogenated Piccopale 100, a styrene-vinyl toluene copolymer, Piccolastic A-75, 100 and 125, all polystyrenes, Piccodiene 2215, a polystyrene-olefin copolymer, all from Pennsylvania Industrial Chemical Corp.; Araldite 6060 and 6071, epoxy resins from Ciba; R5061A, a phenyl -methyl silicone resin, from Dow Corning; Epon 1001, a bisphenol A-epichlohydrin epoxy resin, from Shell Chemical Corp.; and PS-2, PS-3, both polystyrenes, and ET-693, a phenol-formaldehyde resin, from Dow Chemical; a custom synthesized 80/20 mole per cent copolymer of styrene and hexylmethacrylate, a custom synthesized polydiphenylsiloxane; a custom synthesized polyadipate; acrylic resins available under the trademark Acryloid from Rohm & Haas Co., and available under the trademark Lucite from the E. I. DuPont de Nemours & Co.; thermoplastic resins available under the trademark Pliolite from the Goodyear Tire & Rubber Co.; a chlorinated hydrocarbon available under the trademark Arocolor from Monsanto Chemical Co.; thermoplastic polyvinyl resins available under the trademark Vinylite from Union Carbide Co. and blends thereof.

The above group of materials is not intended to be limiting, but merely illustrative of materials suitable for softenable layer 12. The softenable layer may be of any suitable thickness, with thicker layers generally requiring a greater potential for charging. In general, thicknesses from about ½ to about 16 microns have been found to be preferred with a thickness from about 1 to about 4 microns being found to be optimum. If the layer is thinner than about ½ micron, excessive background may result upon liquid wash away development, while layers thicker than about 16 microns require relatively long development time resulting in lower image densities.

The thickness of layer 13 is preferably from about 0.01 to about 2.0 microns thick, although five micron layers have been found to give good results for some materials.

When layer 13 comprises particles, a preferred average particle size is from about 0.01 to about 2.0 microns to yield images of optimum resolution and high density compared to migration layers having particles larger than about 2.0 microns. For optimum resultant image density the particles should not be much above about 0.7 microns in average particle size. Layers of particle migration material preferably should have a thickness ranging from about the thickness of the smallest element of migration material in the layer to about twice the thickness of the largest element in that layer. It should be recognized that the particles may not all be packed tightly together laterally or vertically so that some of the thickness of layer 13 may constitute softenable material.

Layer 13 may comprise any suitable material selected from an extremely broad group of materials and mixtures thereof including electrical insulators, electrical conductors, electrically photosensitive materials and electrically-photosensitively inert particles. Optimally, the migrating portions of layer 13 are sufficiently electrically insulating to hold their electrical migration force until the desired amount of migration has occurred. Conductive particles may be used, however, if lateral conductivity is minimized by loose packing, for example, or by partly embedding only a thin layer of particles in layer 12 so that neighboring particles are in poor electrical contact.

Migration material preferably should be substantially insoluble in the softenable material and otherwise not adversely reactive therewith, and in any solvent liquid or vapor which may be used in the softening step hereof.

While it is preferred for images of highest resolution and density that the fracturable material be particulate, and especially, particles in a range of from about 0.01 to about 2.0 microns in size, it may comprise any continuous or semi-continuous such as a swiss cheese pattern, fracturable layer which is capable of breaking up during the development step and permitting portions to migrate to the substrate in image configuration.

Electrically photosensitive materials for layer 13, permit the imaging members hereof to be electrically latently imaged by the preferred charge-exposure mode.

Any suitable electrically photosensitive fracturable material may be used herein. Typical such materials include inorganic or organic photoconductive insulating materials.

While photoconductive materials (and "photoconductive" is used in its broadest sense to mean materials which show increased electrical conductivity when illuminated with electromagnetic radiation and not necessarily those which have been found to be useful in xerography in a xerographic plate configuration) have been found to be a class of materials useful as "electrically photosensitive" migration materials in this invention and while the photoconductive effect is often sufficient in the present invention to provide an "electrically photosensitive" migration material it does not appear to be a necessary effect. The necessary effect according to the invention is the selective charge receptivity of the material or relocation of charge into, within and out of the material, said receptivity or relocation being effected by light action on the bulk or the surface of the "electrically photosensitive" material, by exposing said material to activating (i.e., actinic) radiation; which may specifically include photoconductive effects, photoinjection, photoemission, photochemical effects and others which cause said selective receptivity or relocation of charge.

Typical inorganic photoconductors include amorphous selenium; amorphous selenium alloyed with arsenic, tellurium, antimony or bismuth, etc.; amorphous selenium or its alloys doped with halogens; cadmium sulfide, zinc oxide, cadmium sulfoselenide, cadmium yellows such as Lemon Cadmium Yellow X-2273 from Imperial Color and Chemical Dept. of Hercules Powder Co., and many others. Middleton et al U.S. Pat. No. 3,121,006 lists typical inorganic photoconductive pigments. Typical organic photoconductors include azo dyes such as Watchung Red B, a barium salt of 1-(4′methyl-5′-chloroazobenzene-2′-sulfonic acid)-2-hydrohydroxy-3-napthoic acid, C.I. No. 15865 and quinacridones such as Monastral Red B, both available from DuPont; Indofast double scarlet toner, a Pyranthrone type pigment available from Harmon Colors; quindo magenta RV-6808, a quinacridone-type pigment available from Harmon Colors; Cyan Blue, GTNF, the beta form of copper phthalocyanine, C.I. No. 74160, available from Colloway Colors; Monolite Fast Blue GS, the alpha form of metal-free phthalocyanine, C.I. No. 74100, available from Arnold Hoffman Co.; commercial indigo available from National Aniline Division of Allied Chemical Corp.; yellow pigments prepared as disclosed in applications Ser. No. 421,281 filed Dec. 28, 1964, U.S. Pat. No. 3,447,922, or as disclosed in Ser. No. 445,235 filed Apr. 2, 1965, U.S. Pat. No. 3,402,177, x-form metal-free phthalocyanine prepared as disclosed in Ser. No. 505,723, filed Oct. 29, 1965, U.S. Pat. No. 3,357,989, quinacridonequinone from DuPont, sensitized polyvinyl carbazone, Diane Blue, 3,3′-methoxy-4,4-diphenyl-bis (1″ azo-2″-hydroxy-3″-naphthanilide), C.I. No. 21180, available from Harmon Colors; and Algol G.C.

1,2,5,6-di (D,D'-diphenyl)-trizole-anthraquinone, C.I. No. 67300, available from General Dyestuffs, and mixtures thereof. The above list of organic and inorganic photoconductive photosensitive materials is illustrative of typical materials, and should not be taken as a complete listing of photosensitive materials.

Photosensitive materials such as the materials comprising amorphous selenium for example, amorphous selenium or amorphous selenium alloyed with arsenic, tellurium, antimony, bismuth, etc., or amorphous selenium or an alloy thereof doped with a halogen are optimum electrically photosensitive materials because of the optimum migration images they form and because electrical latent images associated therewith are erased so completely by this invention.

The fracturable layer for the preferred layered configuration in FIG. 1, which is found to produce optimum quality images according to this invention, may be formed by any suitable method. Typical methods include inert gas vacuum evaporation such as disclosed in copending application Ser. No. 423,167, filed Jan. 4, 1965, wherein a fracturable layer of submicron size particles of the optimum material amorphous selenium is formed on a softenable layer. The fracturable layer may be formed by other methods such as by cascading, dusting, etc., as shown in copending application 460,377, U.S. Pat. No. 3,520,681. A more detailed description of the layered configuration imaging member may be found in copending application Ser. No. 634,256, filed May 1, 1967, U.S. Pat. No. 3,452,811.

In addition to the configuration shown in FIG. 1 additional modifications in the basic structure such as the use of the binder form wherein the structure comprises fracturable material dispersed in the softenable layer, as described in Ser. No. 837,591 also may be used. In addition, an overcoated structure in which the fracturable material is sandwiched between two layers of the softenable material which overlays a substrate is also included within the scope of this invention. When a binder structure is used, the methods set forth in Middleton U.S. Pat. No. 3,121,006 may be used to form the binder structure.

Figure 2:
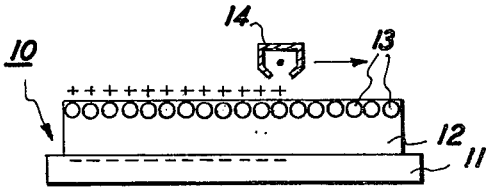
FIGS. 2 and 3 are illustrations of the steps of one embodiment of forming a first electrical latent image (to be erased) on an imaging member employing a layer of electrically photosensitive migration material, said latent image formed by the steps of (FIG. 2) electrically charging said member to a first polarity and (FIG. 3) imagewise exposing said member.
Figure 3:
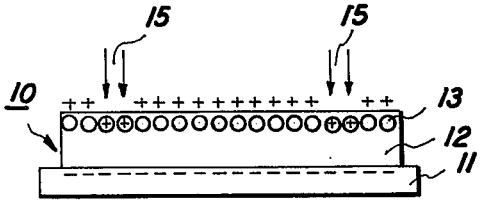

Referring now to FIGS. 2 and 3 the first electrical latent image (to be erased by this invention) is formed in one process embodiment hereof by electrically charging the member (FIG. 2) and exposing the member to an imagewise pattern of actinic radiation (FIG. 3).

Referring now to FIG. 2, the imaging member is electrically charged, generally substantially uniformly, in the substantial absence of actinic radiation for layer 13, illustratively by means of a corona discharge device 14 which is shown to be traversing the member from left to right depositing a uniform charge, illustratively positive, on the surface of layer 13. For example, corona discharge devices of the general description and generally operated as disclosed in Vyverberg U.S. Pat. No. 2,836,725 and Walkup U.S. Pat. No. 2,777,957 have been found to be excellent sources of corona useful in the charging of member 10. Other charging techniques ranging from rubbing the member, to induction charging, for example as described in Walkup U.S. Pat. No. 2,934,649 are available in the art. The surface charge potentials of layer 13, due to the initial charge step hereof, preferred for imaging herein may run from a few to as high as 4,000 volts for both layer and binder configurations. Thicker softenable layers typically require higher potentials. For positive polarity electrical latent images the potential should be from about 100 to 300 volts to yield optimum results. When forming negative polarity, electrical latent images optimum results are obtained when the surface potential of layer 13 is from about 25 to about 150 volts. The polarity of charge in the first uniform electrostatic charging step hereof may be either positive or negative. The initial charging and imagewise exposure steps may be carried out in sequence, may overlap or may be carried out simultaneously.

Where substrate 11 is an insulating material, charging of the member, for example may be accomplished by placing the insulating substrate in contact with a conductive member and charging as illustrated in FIG. 2. Alternatively, other methods known in the art of xerography for charging xerographic plates having insulating backings may be applied. For example, at least two corona charging devices at least one on each side of the member and oppositely charged may be traversed in register relative to member 10 to charge it.

Referring now to FIG. 3, there is shown an imagewise exposure of member 10 by actinic radiation 15. Preferred exposure levels for line copying are generally found to fall between from about zero f.c.s. in non-exposed areas to from about 1 f.c.s to about 6 f.c.s. of white light in illuminated areas to provide for optimum quality images, although greater exposures can be used. These exposure levels give maximum density, high contrast images and higher exposure levels are not found to enhance image quality, thus exposures over about 6 f.c.s. are generally thought to be unnecessary. Exposures between these two levels of about zero and from about 1 f.c.s. to about 6 f.c.s. will provide continuous tone images.

For purposes of illustration, surface electrical charges deposited in FIG. 2 are depicted as having moved into particulate layer 13 in the illuminated areas. Although this representation is speculative, it is helpful for an understanding of the present invention to consider electrical charges deposited in the initial charging step to be more firmly bound to layer 13 or to be injected more firmly into layer 13 in imagewise illuminated areas as a result of the imagewise exposure step illustrated in FIG. 3.

Referring now to FIG. 5, the first electrical latent image is erased by subjecting the member to a negative corona discharge or generically, uniformly charging the member with a charge of a polarity opposite said first polarity, of FIG. 2. The negative corona discharge is applied, as illustrated in FIG. 5, by corona discharge device 16 similar to device 14. Ionization electrical charging i.e., corona charging (including electron charging) is preferred because of the consistency and quality of the migration images produced when ionization charging is employed in this invention. Corona wire discharge charging is a preferred mode of corona charging because of its simplicity, relatively high charging rate and because of the uniformity of application of charge. However, any suitable source of corona, i.e., ions ("ions" intended to include electrons) which permits the ions to be subsequently attracted to the surface of the member to charge it may be used, including radioactive sources described in Dessauer, Mott, Bogdonoff, Photo Eng. 6, 250 (1955) and short-gap, low discharge ionization, for example, as described in the aforementioned Schwertz Patents.

In this subsequent charging step, the member, in imaging area portions, is reduced to at least about zero potential and preferably to a low potential of a polarity opposite said first polarity to ensure in the case of inert migration material that at least a zero potential condition has been reached in the imaging areas of said member and to additionally ensure where electrically photosensitive migration material is used, depolarization of the migration material and thus complete erasing. The illustratively negative recharge step appears to neutralize the initial electrical latent image of positive charge injected into layer 13 as well as the charge on the surface of member 10.

When the later electrical latent image is formed by the charge-expose mode, it is thought that complete erasure in some cases does not take place until the member is charged just prior to the later imagewise exposure step.

The charging just prior to or simultaneous with the later imagewise exposure step is preferably of a first polarity which allows almost any mode of development of said later electrical latent image to be used. If this charging is of a polarity opposite said first polarity then heat development is preferred for optimum results showing no first electrical image ghosting.

When the first electrical latent image is an electrostatic latent image applied for example by charging through a stencil, this image is preferably erased either by A.C. corona charging or by first charging the member for example, with a D.C. corona device, to bring its entire imaging area to the same potential and polarity as the electrostatic latent image and then charging with opposite polarity charge to bring the imaging area to about zero potential or a low opposite polarity potential. Especially where heat softening development is used, the second electrical image may be an electrostatic image of either polarity or a charge-expose formed electrical image where the charging is of either polarity. However, it is preferred for optimum erasing with no ghosting from the first electrical image with almost any developing technique that the later electrical latent image to be developed be of a first polarity.

Figure 4:
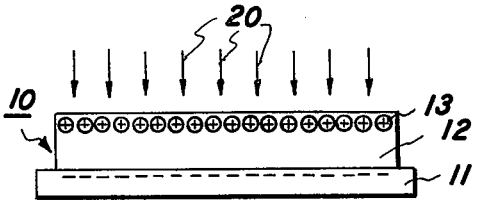
FIG. 4 is a view of the optional uniform exposure step according to the invention. This step is useful when electrically photosensitive migration material is used and the first electrical image is formed by charging and exposing. In this mode, the uniform exposure step is used before the later electrical latent image is formed and during or after the imagewise exposure used to form the electrical latent image to be erased.

Referring now to FIG. 4, there is shown the optional step of a uniform exposure of member 10, employing electrically photosensitive migration material, by actinic radiation 20. Suitable uniform exposure levels of this invention, generally are from about 1 to 10 times those of the imagewise exposure step explained in reference to FIG. 3. This uniform exposure is preferably from about 1 f.c.s. to about 1000 f.c.s. or more to provide for optimum quality images. Any suitable actinic electromagnetic radiation may be used. Typical types include radiation from ordinary incandescent lamps, x-rays, beams of charged particles, infrared, ultra violet and so forth depending on the photosensitive material used.

Although this uniform exposure step following the formation of the electrical latent image which is to be erased is optional a more uniform result with no trace of previous electrical latent images is observed when the uniform exposure step is used. It is believed that this uniform exposure step brings all the migration particles to about the same degree of polarization by "washing out" the weaker imagewise polarization. With or without this uniform exposure step, the reversal of charge polarity is believed to cause recombination in and depolarization of the electrically photosensitive migration particles. For purposes of illustration, the charges on the imagewise unexposed areas of layer 13 are depicted as having moved into layer 13 as a result of the uniform exposure step.

After erasure of the previous electrical latent image a new, later electrical latent image is formed in or on the member by any technique disclosed in Ser. No. 837,780 and Ser. No. 837,591.

It will be appreciated that although the imaged member with the new electrical latent image is then usually developed to cause imagewise migration of particles and to render the latent image visible, the electrically latent imaged member is a useful end in itself being stable for a matter of usually at least minutes and weeks in some cases and thus potentially developable.

The electrical latent image erasing system of this invention may be employed where the original image is a positive charge image and the erasing charging step applies a negative charge and when the original image is a negative charge image and the erasing charging step applies a positive charge. However, the first of these two modes appears to be preferred in that erasure of the electrical latent image seems to be consistently good, while in the latter condition, i.e., with the original electrical latent image to be erased being a negative image there is some inconsistency in the results.

One preferred technique for improving the consistency and the completeness of erasure of a negative electrical latent image is to slightly soften the imaging member for a few seconds after the recharging positive step. For preferred migration imaging materials, a preferred softening is to heat the member in heating range and time from between about 50°C. to about 130°C. for from between about 1 to about 20 seconds to achieve the desired result.

It is thought that the heating allows the positive charge deposited on the imaging member to pass from the film's upper surface to the electrically photosensitive particle where it neutralizes any negative charge that might be associated with the particles. Any excess positive charge is not retained by the particle possibly because of its injection from the particle into the softenable layer.

Referring now to FIG. 6, the next step, typically, is to develop the later electrical latent image to render it visible, which is usually done in the absence of actinic radiation for the member where electrically photosensitive migration material is used, and the later electrical image is formed by the charge-expose mode by softening or dissolving away layer 12 to permit imagewise portions of layer 13 to migrate toward substrate 11. As illustrated, one mode of accomplishing development is liquid solvent developing accomplished by temporarily contacting member 10 with a solvent for softenable layer 12, for example, by immersing member 10 in container 23 containing a liquid solvent 24 for layer 12.

It should be understood that although preferred in many instances, because of the high contrast images, with no or low background which result from simple, direct liquid solvent wash away development; as described in the two aforementioned and incorporated by reference copending applications, development of the imaging members hereof may also be accomplished by softening the softenable layer, for example, with solvent vapor or heat or combinations thereof, or quick dips in liquids to cause softenable layer swelling to cause imagewise migration of portions of fracturable migration material, and although layer 12 and unmigrated areas of fracturable material are typically not thereby washed away, the image produced may still be viewable directly and in transmission. Readout may also be by means of appropriate sensing means that can detect the selective displacement of particles. For example, magnetic sensing means may be used in conjunction with a layer 13 having a magnetic component.

Moreover, a liquid solvent may at any time thereafter be applied to such an image to convert it into a solvent wash-away image as illustrated in FIG. 7. In this regard, it is further noted that the liquid solvent applied in this wash-away step need not be insulating, conductive liquids may be used. It has also been found that nonmigrated background areas of fracturable material of such a migration image may be removed by abrasion to yield a readily visible image, or the relatively unmigrated areas may be adhesively stripped off to yield complementary positive and negative images.

Generally, solvent 24 and solvents used for vapor softening herein should preferably be a solvent for layer 12, but not for layers 13 and 11 and should have high enough electrical resistance to prevent the migrating material of layer 13 from losing its charge before migrating. Typical solvents for use with various materials which may comprise layer 12 include acetone, trichloroethylene, chloroform, ethyl ether, xylene, dioxane, benzene, toluene, cyclohexane, 1,1,1-trichloroethane, penthane, n-heptane, trichlorotrifluoroethane available under the designation Freon 113 from the E. I. DuPont de Nemours & Co., M xylene, carbon tetrachloride, triophene, diphenyl ether, p-cyamine, cis-2,2-dichloroethylene, nitromethane, n,n-dimethyl formamide, ethanol, ethyl acetate, methyl ethyl ketone, ethylene dichloroide, methylene chloride, trans 1,2-dichloroethylene, Super Naphtholite available from Buffalo Solvents and Chemicals and mixtures thereof.

The following examples further specifically define the present migration imaging electrical latent image erasing proccess of this invention. The parts and percentages are by weight unless otherwise indicated. All exposures are from a tungsten filament light source. The Examples below are intended to illustrate various preferred embodiments of the erasing process of this invention.

EXAMPLE I

Two identical imaging members such as that illustrated in FIG. 1 are prepared by first dissolving about 15 parts of a custom synthesized about 80/20 mole per cent copolymer of styrene and hexylmethacrylate having a molecular weight of about 45,000 (weight average) in about 100 parts toluene. Using a gravure roller, the solution is then roll coated onto about a 3 mil Mylar polyester film having a thin semi-transparent aluminum overcoating. The solution coating is applied so that when air dried to allow for evaporation of the toluene solvent, about a 1½ or 2 micron layer of copolymer is formed on the aluminized Mylar. A thin layer of vitreous selenium, observed microscopically to be particulate, approximately 0.5 microns in thickness is then deposited onto the copolymer surface by vacuum deposition utilizing the direct vacuum deposition process set forth in copending application Ser. No. 813,345 filed Apr. 3, 1969, now abandoned.

Both members then have a first electrical latent image formed on them by charging the members under dark room conditions to a positive potential of about 100 volts through the use of a corona charging device such as that set forth in Carlson U.S. Pat. No. 2,588,699. Each member is then exposed to a first optical image, exposure being about 5 f.c.s. in the illuminized areas. The first member is then developed, i.e., softened while still maintaining dark room conditions by immersing in vapors of 1,1,1-trichloroethane by holding the film between a pair of tweezers and placing it into a 2 liter bottle containing about 100 cc.'s of liquid 1,1,1-trichloroethane in the bottom. The film is held above the liquid developer and exposed to the vapors above the liquid for about 3 seconds and then removed from the bottle. A migration image is formed with the selenium particles in the optically exposed areas having migrated to or near the substrate while the selenium particles in the unexposed areas remain substantially intact. This shows conclusively of course that there is an electrical latent image on the second member which has been latent imaged the same way but has not been developed.

The second member with the electrical latent image thereon is then corona charged negatively to a low negative potential of about −10 volts, although potentials from about zero to about −30 gave the same preferred results. The imaging member is then recharged positively to a surface potential of about 100 volts as before and exposed to a later optical image with exposure at about 5 f.c.s. in the illuminated areas, this later optical image differing totally in composition from the first optical image. The second member is then developed similar to the way the first member was developed to produce a migration image with selenium particles migrating in the exposed areas corresponding to the later optical image with no noticeable sensitivity difference or ghost imaging relating to the first optical exposure being observed.

EXAMPLE II

Example I is followed except that the imaging member has sequentially four different electrical latent images formed on it by the process described in Example I from four totally different imagewise exposures, each latent imaging followed by a negative charge erasing step as described in Example I with a fifth electrical latent image being formed as described in Example I with a fifth optical input image different from any other previous images followed by development with the fifth later image being clearly developed with no ghosting being observed and no noticeable changes in the films imaging characteristics, and especially the density *v* log exposure curve.

EXAMPLE III

Example I is followed except that about +40 volts is used instead of about +100; about zero potential to about −10 volts is used instead of −10 volts, the exposures are about 1 f.c.s in illuminated areas and development is carried out by dissolving in 1,1,1-trichloroethane liquid to produce an imaged member as illustrated in FIG. 7 corresponding to the later optical image with no evidence of the first electrical latent image being observed.

EXAMPLE IV

Example III is followed except +50 volts is used instead of about +40 and about −20 volts is used instead of about 0 to about −10 volts. Also, the vapor softening development of Example I is used. Upon development, particles migrated corresponding to the later image exposure with no ghosting, i.e., no evidence of first erased electrical latent image, and no noticeable changes in the films imaging characteristics.

EXAMPLE V

Example IV is followed except that about +60 volts is used instead of about +50 for the first electrical latent image formation and erasure is followed by another latent image formation employing charging to about +50 volts, exposing to about 1 f.c.s in illuminated areas followed by recharging to about −30 volts to erase followed by a third electrical image formation of charging to about +45, exposure and development as in Example IV. The same beneficial results as in Example IV are obtained with development only of the third image pattern.

EXAMPLE VI

Example III is followed except that about +60 volts is used instead of about +40 for the initial charge and about +30 is used instead of about 0 to about −10 volts. Also, there is a uniform exposure to the room lights after the imagewise exposure forming the first electrical latent image. A potential of about +50 is then used followed by imagewise exposure to a later, different optical image and development as in Example IV to produce the same beneficial results as in Example IV.

EXAMPLE VII

Imaging members are provided as in Example I.

A negative electrical latent image is formed on the film by charging the film under dark room conditions to a negative surface potential of about −280 volts by the use of a corona charging device. The film is then exposed to an optical image, the exposure at about 1 f.c.s. in illuminated areas. The member is then charged positively to a low positive surface potential of about 10 to about 40 volts (up to about 100 volts produced the same preferred results) and then the film is heated for about 20 seconds at about 110°C. The room lights can be on or off during the above steps.

The member is then charged negatively again as previously described in this Example and exposed to a later optical input image and developed by heat softening by heating at about 110°C. for about 20 seconds to produce migration in the areas corresponding to the exposed areas produced by the later optical image. No noticeable sensitivity change or ghost imaging is observed.

EXAMPLE VIII

Example III is followed except that vapor development is used as in Example I.

EXAMPLES IX – XI

Examples IV–VI are followed except that liquid wash away development as in Example III is used.

The term "electrical latent image" and the several variant forms thereof used herein includes the images formed by the charge-expose mode hereof which cannot readily be detected by standard electromagnetic techniques as an electrostatic image for example of the type found in xerography, so that no readily detectable or at best a very small change in the electrostatic or coulombic force is found after exposure (when using preferred exposure levels); and electrostatic latent images of a type similar to those found in xerography which are typically readily measurable by standard electrometers, that is the electrostatic latent images show a surface potential reading typically of at least about 5 to 10 volts.

Although specific components and proportions have been stated in the above description of preferred embodiments of the migration imaging electrical latent image erasing imaging system hereof, other suitable materials as listed herein may be used with similar results. In addition, other materials and other configurations of the imaging member may be provided and variations may be made in the various processing steps to synergize, enhance and otherwise modify the sytem. For example, various plasticizers, additives, moisture and other "proofing" agents may be added to the softenable materials as desired.

It will be understood that various other changes in the details, materials, steps and arrangements of the members which have been herein described and illustrated in order to explain the nature of the invention will occur to and may be made by those skilled in the art upon a reading of this disclosure and such changes are intended to be included within the principle and scope of this invention.

What is claimed is:

1. A migration imaging electrical latent image erasing method comprising the steps of:

a. providing an imaging member comprising fracturable migration material in a softenable layer, said softenable layer capable of having its resistance to migration of said fracturable migration material decreased sufficiently to allow migration of said fracturable migration material in depth in said softenable layer, said member having a first electrostatic latent image of a first polarity;

b. electrically charging said member first with a charge of a polarity the same as said first polarity to raise said member in imaging area portions to a surface potential of a magnitude and of a polarity matching said electrostatic latent image followed by charging said member in imaging area portions to charge of a polarity opposite said first polarity to bring said member in imaging area portions to a surface potential of at least about zero potential; and c. then forming on said member a later electrical latent image, typically differing in composition from said first electrostatic latent image; whereby upon developing said member migration material migrates at least in depth in said softenable layer in an image configuration corresponding to said later electrical latent image and not said first electrostatic latent image.

2. An imaging method according to claim 1 wherein said fracturable migration material is electrically photosensitive and including the step of uniformly exposing said member to radiation which is actinic for said electrically photosensitive material during or after the charging step which raises the member to the same potential as the electrostatic latent image and before the step where the member is charged to an opposite polarity to bring it to at least about a zero potential.

3. A migration imaging electrical latent image erasing method comprising the steps of: l a. providing an imaging member comprising a substrate, a substantially electrically insulating softenable layer on said substrate, said softenable layer being between about ½ and 16 microns thick, a fracturable migration material layer from about 0.01 to 5 microns thick of fracturable migration particles of an average particle size from about 0.01 to about 2 microns contiguous the surface of said softenable layer opposite said substrate and contacting said softenable layer, said softenable layer capable of having its resistance to migration of said fracturable migration material decreased sufficiently to allow migration of said fracturable migration material in depth in said softenable layer, saidi member having a first electrostatic latent image of a first polarity;

b. electrically charging said member first with a charge of a polarity the same as said first polarity to raise said member in imaging area portions to a surface potential of a magnitude and of a polarity matching said electrostatic latent image followed by charging said member in imaging area portions to charge of a polarity opposite said first polarity to bring said member in imaging area portions to a surface potential of at least about zero potential; and c. then forming on said member a later electrical latent image, typically differing in composition from said first electrostatic latent image; whereby upon developing said member migration material migrates at least in depth in said softenable layer in an image configuration corresponding to said later electrical latent image and not said first electrostatic latent image.

4. An imaging method according to claim 3 wherein said fracturable migration material is electrically photosensitive and including the step of uniformly exposing said member to radiation which is actinic for said electrically photosensitive material during or after the charging step which raises the member to the same potential as the electrostatic latent image and before the step where the member is charged to an opposite polarity to bring it to at least about a zero potential.

* * * * *